United States Patent [19]

White et al.

[11] Patent Number: 4,771,727

[45] Date of Patent: Sep. 20, 1988

[54] STAMP AND ENVELOPE MOISTENER

[76] Inventors: Daniel B. White, 109 Vassar Ave., Somerdale, N.J. 08083; George Spector, 233 Broadway Rm 3815, New York, N.Y. 10007

[21] Appl. No.: 54,213

[22] Filed: May 26, 1987

[51] Int. Cl.[4] ..... B05C 1/06; B05C 1/08

[52] U.S. Cl. ..... 118/258; 401/48; 401/145; 401/164; 401/172; 401/184; 401/208; 401/220; 222/386.5

[58] Field of Search ..... 401/48, 208, 218, 220, 401/145, 150, 151, 172, 183, 184, 164; 222/386.5, 390; 221/135; 118/257, 258

[56] References Cited

U.S. PATENT DOCUMENTS

| | | | |
|---|---|---|---|
| 207,160 | 8/1878 | Brown | 401/220 |
| 812,087 | 2/1906 | Peterson | 401/172 |
| 989,685 | 4/1911 | Zittle et al. | 118/258 |
| 1,243,967 | 10/1917 | Nielsen | 401/145 X |
| 1,483,094 | 2/1924 | Jones | 118/258 |
| 2,284,207 | 5/1942 | Hawkins | 401/172 X |
| 2,419,959 | 5/1947 | Landau | 118/258 |
| 2,548,653 | 4/1951 | Cromwell | 401/208 X |
| 2,688,305 | 9/1954 | Wray et al. | 118/257 X |
| 3,263,265 | 8/1966 | Judson | 401/208 X |
| 4,204,538 | 5/1980 | Cannon | 222/386.5 X |
| 4,350,458 | 9/1982 | Murahara et al. | 401/151 X |

*Primary Examiner*—Richard J. Apley
*Assistant Examiner*—David J. Bender

[57] ABSTRACT

A liquid dispensing applicator for moistening glue on stamps, envelopes and the like is provided and consists of a liquid holding reservoir tank having an open top and a roller rotatably supported within the reservoir tank positioned to slightly extend above the open top in which rotation of the roller will allow a proper amount of liquid to be picked up from within the chamber and applied to the glue. The roller is rotatingly supported by endwalls of the tank, and a diaphragm-like bottom floor within the tank adjustingly elevates the level of the liquid in the tank via an adjusting screw.

4 Claims, 1 Drawing Sheet

STAMP AND ENVELOPE MOISTENER

BACKGROUND OF THE INVENTION

The instant invention relates generally to containers and more specifically it relates to a liquid dispensing applicator.

Numerous containers have been provided in prior art that are adapted to apply liquid contents thereof to a given surface. For example, U.S. Pat. Nos. 2,732,575; 3,048,880 and 3,100,908 all are illustrative of such prior art. While these units may be suitable for the particular purpose to which they address, they would not be as suitable for the purposes of the present invention as heretofore described.

SUMMARY OF THE INVENTION

A primary object of the present invention is to provide a liquid dispensing applicator that will overcome the shortcomings of the prior art devices.

Another object is to provide a liquid dispensing applicator that inlcudes a roller which will pick up a proper amount of liquid when rotated and apply the liquid on anything with glue on it.

An additional object is to provide a liquid dispensing applicator that includes a flexible bottom floor to raise level of liquid when low.

A further object is to provide a liquid dispensing applicator that is simple and easy to use.

A still further object is to provide a liquid dispensing applicator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
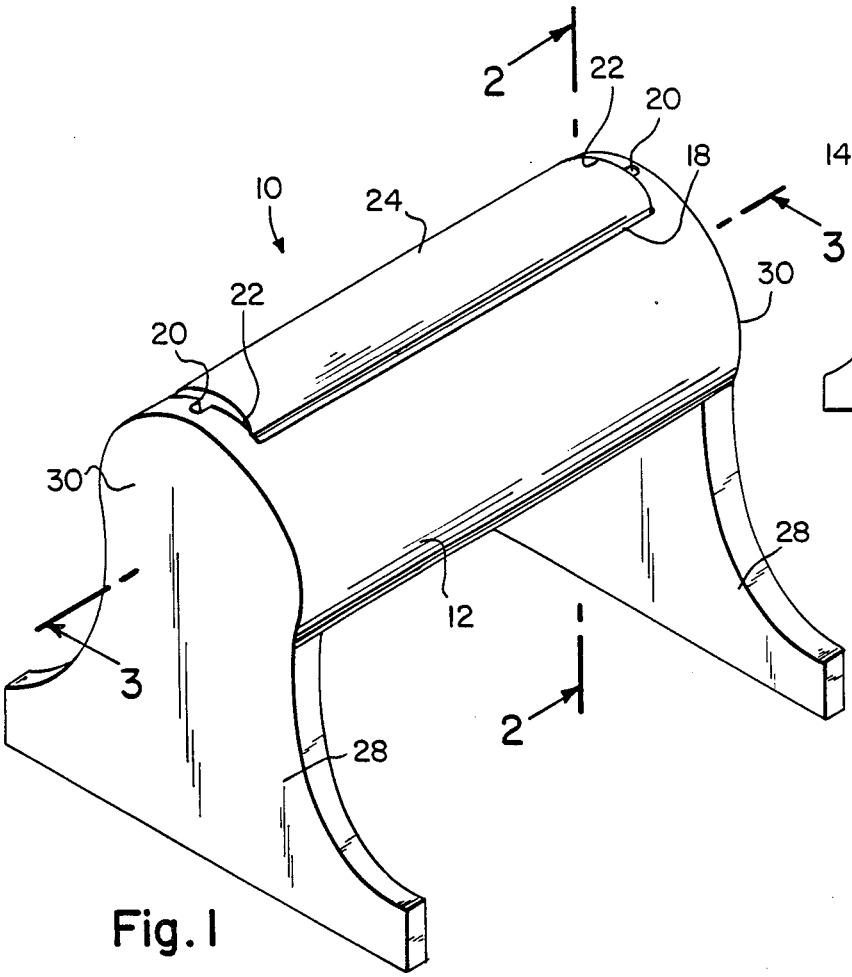
FIG. 1 is a perspective view of the invention.
Figure 2:
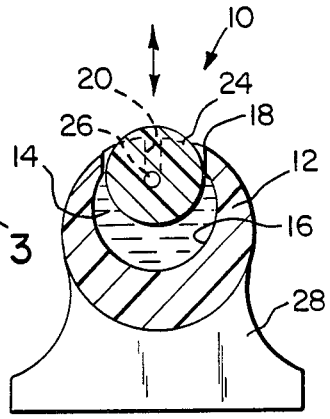
FIG. 2 is a cross sectional view taken along line 2—2 in FIG. 1.

Turning now descriptively to the drawings, in which similar reference characters denote similar elements throughout the several views, FIGS. 1 and 2 illustrate a liquid dispensing applicator 10 for moistening glue on stamps, envelopes and the like (not shown), that contains a reservoir tank 12 for holding liquid 14, such as water therein. The reservoir tank 12 has an elongated chamber 16 therein with an open top 18 and a pair of vertical slots 20. Each of the slots 20 are placed at an opposite end 22 of the chamber 16 and extends downwardly from the open top 18.

A roller 24 is provided that has a pair of axial projecting shafts 26 at each end 28 thereof to rotatably support the roller 24 in the vertical slots 20 within the reservoir tank 12. The roller 24 is slightly smaller in diameter than the open top 18 so as to fit within the chamber 16. The roller 24 is positioned to slightly extend above the open top 18 in which rotation of the roller 24 will allow proper amount of liquid 14 to be picked up from within the chamber 16 and applied to the glue on the stamps, envelopes and the like.

The reservoir tank 12 is cylindrical shaped and the chamber 16 therein is cylindrical shaped and larger in diameter than the open top 18 so as to hold a greater amount of liquid 14 therein. A pair of legs 28 are provided with each extending downwardly from an opposite end 30 of the cylindrical reservoir tank 12 so as to elevate and stabilize the cylindrical reservoir tank.

Figure 3:
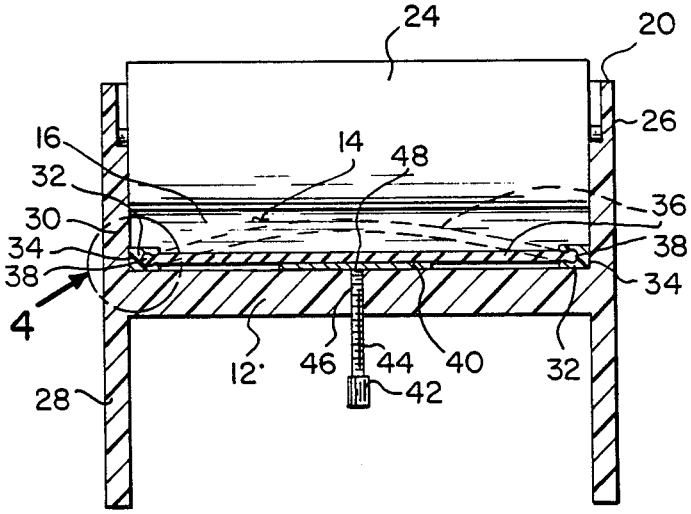
FIG. 3 is a cross sectional view taken along line 3—3 in FIG. 1 showing a flexible bottom floor to raise level of liquid when low.
Figure 4:
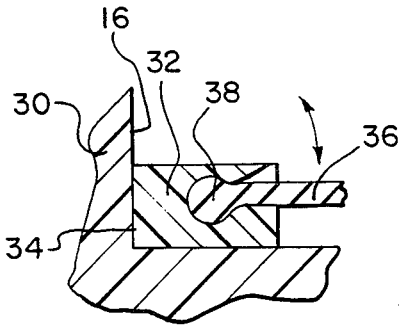
FIG. 4 is an enlarged cross sectional view as indicated by arrow 4 in FIG. 3 showing the socket member and sealing edge therein.

FIGS. 3 and 4 show a modified liquid dispensing applicator **10*a* further comprising a socket member 32 mounted around perimeter 34 of the chamber 16 in the reservoir tank 12. A diaphram like bottom floor 36 that has a sealing edge 38 extends into the socket member 32 so as to surround the liquid 14. A plate 40 is centrally positioned under the diaphram like bottom floor 36 and a screw 42 that has a shank 44 is threaded through bottom center 46 of the reservoir tank 12. Free end 48 of the shank 44 can bear against the plate 40 to lift the diaphram like bottom floor 36 upward to raise level of the liquid 14** therein when the liquid is low.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A liquid dispensing applicator for moistening glue on stamps, envelopes and the like, said applicator comprising:

(a) a reservoir tank for holding liquid therein comprising a bottom, an open top, and a pair of endwalls each having a vertical slot extending downwardly from said open top;

(b) legs to support said reservoir tank;

(c) a roller with two ends, said ends each having an axial projecting shaft, said vertical slots rotatably supporting said axial projecting shafts such that said roller extends above said open top, and into said reservoir tank;

(d) a socket member mounted around the inside perimeter of the bottom of said reservoir tank;

(e) a diaphragm-like bottom floor having a sealed edge extending into said socket member so as to surround liquid in said reservoir tank between said diaphragm-like bottom floor and said roller;

(f) a plate positioned between said diaphragm-like bottom floor and said bottom of said reservoir tank;

(g) a screw threaded through said bottom of said reservoir tank to adjustingly bear against the said plate such that said screw adjustingly elevates said plate and said diaphragm-like bottom floor to adjustingly elevate the level of the liquid in said reservor tank.

2. The liquid dispensing applicator of claim 1, wherein said roller is smaller than said open top of said reservoir tank.

3. The liquid dispensing applicator of claim 1, wherein said reservoir tank is cylindrically shaped.

4. The liquid dispensing applicator of claim 1, wherein said legs are extensions of said endwalls.

* * * * *